US005430801A

United States Patent [19]

Hill

[11] Patent Number: 5,430,801

[45] Date of Patent: Jul. 4, 1995

[54] HEARING AID

[76] Inventor: Frank C. Hill, 1639 Brabham Ave., Columbia, S.C. 29204

[21] Appl. No.: 199,985

[22] Filed: Feb. 22, 1994

Related U.S. Application Data

[63] Continuation-in-part of Ser. No. 167,551, Dec. 14, 1993.

[51] Int. Cl.[6] ..... H04R 25/00

[52] U.S. Cl. ..... 381/69; 381/68; 607/57; 600/25

[58] Field of Search ..... 381/68.3, 68, 68.6, 381/69, 68.7, 68.2, 68.4, 69.1; 600/25; 607/57, 56

[56] References Cited

U.S. PATENT DOCUMENTS

| | | | |
|---|---|---|---|
| 3,346,704 | 12/1963 | Mahoney | 179/107 |
| 3,557,775 | 1/1971 | Mahoney | 128/1 |
| 3,764,748 | 10/1973 | Branch et al. | 179/107 E |
| 4,606,329 | 8/1986 | Hough | 128/1 R |
| 4,776,322 | 10/1988 | Hough et al. | 381/68.6 |
| 5,015,224 | 5/1991 | Maniglia | 600/25 |
| 5,048,090 | 9/1991 | Geers | 381/68.6 |
| 5,085,628 | 2/1992 | Engebretson et al. | 600/25 |
| 5,176,620 | 1/1993 | Gilman | 600/25 |
| 5,239,588 | 8/1993 | Davis | 381/68 |

FOREIGN PATENT DOCUMENTS

| | | | |
|---|---|---|---|
| WO89/05559 | 12/1988 | Germany | H04R 25/00 |
| 962780 | 7/1964 | United Kingdom . | |

*Primary Examiner*—Curtis Kuntz
*Assistant Examiner*—Huyen D. Le
*Attorney, Agent, or Firm*—Michael A. Mann

[57] ABSTRACT

A hearing aid including a microphone fitted through a small hole in the conchal bowl of the user to receive sound impinging the anterior side of the pinna, an electronics package worn behind the pinna that receives the sound from the microphone, and a sound conductor running from the electronics package behind the ear through the soft tissue of the external auditory canal and into the auditory canal medial to the cerumen-producing portion of the canal. The outer end of the sound conductor is detachably connected to the electronics package; the inner end communicates with the auditory canal for directing amplified sound to the ear drum. Alternatively, the inner end of a fluid-filled sound conductor can be attached to the round window of the cochlea or can communicate electromagnetically with an acoustic lens placed against the ear drum.

20 Claims, 3 Drawing Sheets

HEARING AID

This is a continuation-in-part of copending application Ser. No. 08/167,551 filed on Dec. 14, 1993.

BACKGROUND OF THE INVENTION

1. Field of the Invention

The present invention relates to hearing aids. In particular, the present invention relates to a hearing aid having a microphone worn in the conchal bowl of the external ear, an amplifier and power source disposed behind the ear, and a sound conductor running from the housing behind the ear through the soft tissue of the external auditory canal and into the auditory canal medial to the cerumen-producing portion of the canal. The invention further relates to a method for installing said hearing aid.

2. Discussion of Background

The human auditory system includes the outer ear (the auricle or pinna), an auditory canal extending inwardly towards an ear drum or tympanum, a middle ear and an inner ear. The outer ear serves as a collecting dish for sound waves, which are then directed into the auditory canal toward the ear drum. Sound is perceived when the vibrations caused by sound waves are transmitted by the ear drum through the bones of the ossicular chain in the middle ear to the cochlea in the inner ear. The cochlea produces electrical impulses that are transmitted to the brain through the auditory nerve.

An estimated 15% of the population (about 40% of the elderly population) have impaired hearing and could benefit from the use of hearing aids. Most users of hearing aids are fitted with conventional aids of the "air conduction" or "bone conduction" type. Air conduction devices work by collecting incoming sound with a microphone, amplifying the sound and delivering the amplified signal by way of a speaker positioned in the outer portion of the ear canal. Amplifiers may be placed behind the ear or in the ear canal, as in the devices shown by Geers (U.S. Pat. No. 5,048,090) and Wullstein (UK Patent 962,780). Bone conduction aids convert the incoming sound signal into mechanical vibrations that are transmitted to the bone structure of the skull. The resulting vibration of the skull stimulates the cochlea, resulting in a perceived sound.

Implantable hearing devices offer some benefits in specific clinical situations but fail to meet the needs of the majority of those with hearing loss. Some implantable devices stimulate the temporal bone directly. Others vibrate the ossicular chain through various means such as a piezoelectric device or a magnet attached to one of the ossicles. Presently-available implantable devices include those described by Mahoney (U.S. Pat. Nos. 3,346,704 and 3,557,775), Branch (U.S. Pat. No. 3,764,748), Hough (U.S. Pat. No. 4,606,329), and PCT Application WO 89/05559. Implantable devices have been somewhat successful in overcoming problems such as acoustic feedback, but frequently require high power inputs. In addition, some implantable devices interrupt the normal hearing pathway by occluding the external auditory canal or interrupting the ossicular chain.

A number of problems are associated with presently-available hearing aids. In-the-ear or in-the-canal hearing aids block the external auditory canal and interfere with the user's remaining natural hearing, creating what is generally known as the "occlusion effect." These devices alter the acoustical characteristics of the auditory canal and often reduce the normal 8–10 dB amplifying effect of the concha (the central convexity of the external ear). Normal conductive hearing is decreased while bone conduction hearing is enhanced by approximately 9 dB, adversely affecting the user's perception of his own voice. This in turn may result in abnormal voice modulation. In addition, the amplified sound is frequently perceived as harsh and unpleasant due to a different frequency distribution from natural sound.

Children, the elderly and the handicapped may have difficulty with the tiny and/or complicated controls of some in-the-ear hearing aids, due to immaturity, lack of sufficient manual dexterity to manipulate the controls, or lack of sufficient ability to learn new skills. Such users are more successful in manipulating the controls of behind-the-ear aids.

Many users experience problems with acoustic feedback and background noise. Feedback is most evident in highly-miniaturized devices, an unavoidable consequence of the decreased distance from the speaker to the microphone. Poor signal-to-noise ratios result from the fact that hearing aids amplify signals indiscriminately, thus, amplified background noise may prevent a user from hearing and understanding the signal he or she wants to hear. By way of example, it may be difficult to distinguish a conversation from the background noise at a noisy cocktail party.

Of necessity, in-the-ear hearing aids are placed in the portion of the auditory canal that produces cerumen (ear wax), blocking the normal egress of cerumen, forcing it inwardly where it blocks the auditory canal as well as the vent and speaker ports of the aid. In addition, occlusion of the canal prevents the normal circulation of air, creating a "stuffy" sensation and predisposing the user to external ear infections. Some users develop an allergic response or intolerance when using an in-the-ear hearing aid constantly. Venting the device may partially overcome the occlusion effect, but may cause problematic acoustic feedback.

Candidates for hearing aids may refuse binaural fitting because of the cost or the occlusion effect. As a result, they have an imbalance in hearing from ear to ear, which results in difficulty with directional hearing. Devices that aim to provide directional hearing are available. For example, Davis (U.S. Pat. No. 5,239,588) mounts a stereophonic microphone on top of the user's head. Amplifiers are connected immediately adjacent to the microphone and subcutaneous wires connect the amplifiers to electroacoustic transducers in the ear canals.

Some users complain of discomfort when wearing a hearing aid, and many refuse to use one because of its association with aging or infirmity. When others notice that a person is wearing a hearing aid, they often speak in an abnormally loud voice which leads to discomfort. The less noticeable a hearing aid is to others, the more acceptable it is to its user.

Over the years, the size of hearing aids has diminished and their general quality has improved. However, there has been little significant improvement in hearing aid technology. Even the digitally programmable hearing aid, which offers the user some previously-unavailable flexibility in the frequency distribution of the amplified sound, does not represent a revolutionary change. Presently-available hearing aids do not satisfy the need of many potential users for an inconspicuous, easy-to-use device that provides adequate sound amplification with low acoustic feedback. Overall, only about 10% of those who might benefit from a hearing aid actually use one. Thus, a significant problem remains in helping those with hearing impairment. Perhaps the single most important incentive to increased hearing aid use would be an aid with an improved signal-to-noise ratio that uses rather than replaces the user's remaining natural hearing.

SUMMARY OF THE INVENTION

According to its major aspects and broadly stated, the present invention is a hearing aid having a microphone, an electronics package containing a sound amplifier and a power source, and an implantable speaker or sound conductor. The microphone is positioned in the conchal bowl of the user, and the electronics package is placed behind the pinna, connected to the microphone via a small hole formed in the concha. The sound conductor is permanently installed in the external auditory canal region, extending from the housing behind the ear through the soft tissue of the external auditory canal and into the auditory canal medial to the cerumen-producing portion of the canal. The outer end of the sound conductor is connected to the electronics package; the inner end is positioned medial to the cerumen-producing portion of the auditory canal for directing amplified sound towards the ear drum.

Using sound from the anterior side of the pinna for amplification and delivery to the ear drum without blocking the auditory canal is a major feature of the present invention. This arrangement enables the quality of the sound received by the wearer, whether amplified by the present device or received directly through the auditory canal, to be more like what the wearer experienced before hearing loss.

An important feature of the present invention is the arrangement of the implantable sound conductor for delivery of amplified sound to the ear drum. The major portion of the auditory canal is by-passed, leaving it free to function in its normal manner. The inner end of the sound conductor is positioned in the inner portion of the auditory canal, medial to the cerumen-producing portion of the canal and close to the outer surface of the ear drum so that amplified sound is aimed directly at the ear drum. The sound conductor protrudes only a small distance into the auditory canal, preferably no more than approximately 1 mm, to avoid occluding the auditory canal and to preserve the user's natural hearing. Alternatively, the sound conductor bypasses the ear drum to direct amplified sound at the round window of the middle ear.

Another feature of the present invention is the placement of the microphone and the electronics package. The microphone and electronics package are worn in the manner of a "reverse earring," with the electronics package concealed by the external ear and the user's hair and the microphone penetrating through the pinna to receive sound from the front of the pinna, as the user would normally. Placement of the microphone in the conchal bowl not only exploits the natural sound-collecting properties of the external ear and provides protection from wind noise, but also renders the microphone inconspicuous when installed for use. Like the sound conductor, the microphone is positioned so that the user's natural hearing is not blocked but can augment the sound of the present system.

Still another feature of the present invention is the method for installing the heating aid, involving surgery that can be performed under local anesthesia on an out-patient basis. The sound conductor, in the form of a length of flexible tubing, is implanted in the soft tissues of the external auditory canal region, preferably behind the auditory canal with an outer end extending outwards from the posterior surface of the ear and an inner end communicating with the non-cerumen-producing portion of the auditory canal. A small hole is formed through the concha, and, after the hole heals, the microphone is connected to the amplifier input by a stem that passes through the hole. The sound conductor is connected to the receiver output. The non-implanted portion of the hearing aid—the microphone and the electronics—may be removed during sleeping, showering, and so forth simply by disconnecting the electronics package and the microphone from the sound conductor.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
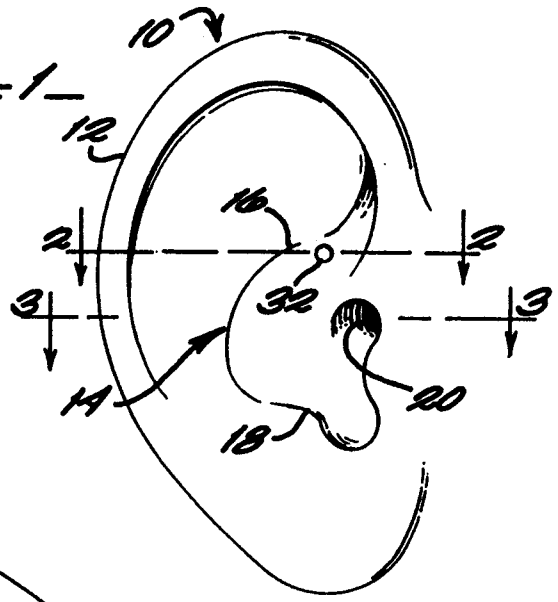
FIG. 1 shows a side view of the ear of a user, with a heating aid according to a preferred embodiment of the present invention installed for use.

In the following description, similar structural elements, portions or surfaces are referred to by the same reference numerals in order to simplify the understanding of the sequential aspect of the drawings. The terms "proximal," "distal," "anterior," "posterior," "medial," "lateral," "inner" and "outer" are used in the customary anatomical sense.

The problems of acoustic feedback, occlusion of the auditory canal, low signal-to-noise ratio and cosmesis are addressed by a heating aid that includes a microphone, an electronics package, and a sound conductor. The microphone is worn preferably in the superior portion of the conehal bowl, and a housing containing the electronics package is worn behind the ear and connected to the microphone via a small hole in the conehal cartilage. When implanted in the user, the sound conductor bypasses the cerumen-producing portion of the external auditory canal and directs amplified sound towards the inner ear. The device augments the user's remaining natural hearing without blocking the external auditory canal.

Figure 2:
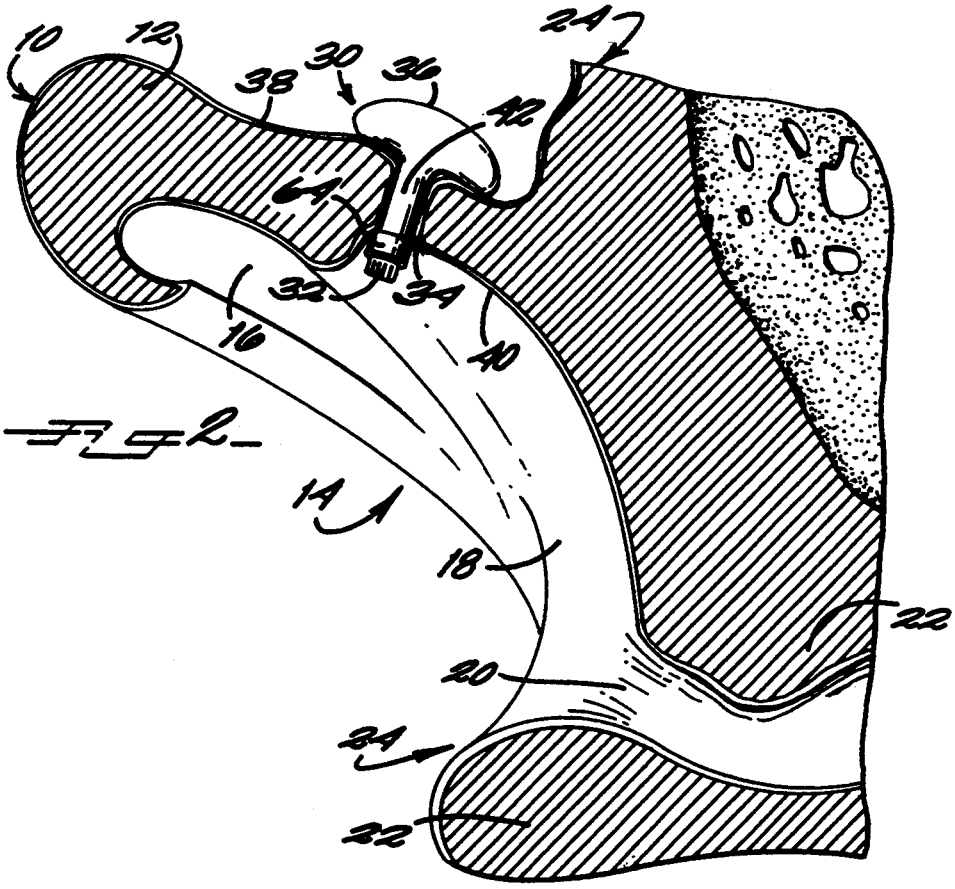
FIG. 2 is a horizontal cross-sectional view along line 2—2 of FIG. 1, showing a microphone and electronics package according to the invention.

Referring now to FIG. 1, there is shown a side view of the ear of a user, with a heating aid according to a preferred embodiment of the present invention installed in the ear. An external ear 10 includes a pinna 12, and a conehal bowl 14 with an upper or superior portion 16 and a lower portion 18. An auditory canal 20 leads from conchal bowl 14 to an ear drum and middle ear (not shown). Canal 20 and surrounding soft tissues 22 constitute an external auditory canal region 24 (FIG. 2). A hearing aid 30 includes a microphone 32 worn in superior portion 16.

As best seen in FIG. 2, microphone 32 is attached to ear 10 via a hole 34 formed through pinna 12. An electronics package 36 is placed against a posterior surface 38 of ear 10, directly behind superior portion 16 of conchal bowl 14. Electronics package 36 contains an amplifier, a battery for energizing the package, a receiver, user-operable controls, and other electronics needed for the operation of aid 30. Depending on the patient and his hearing loss, package 36 may include other electronics such as compression circuitry or noise reduction circuitry. Microphone 32 is positioned near an anterior surface 40 of ear 10, attached to electronics package 36 by a stem 42. Stem 42 contains electrical wiring (not shown) for electrically connecting microphone 32 and package 36.

Figure 3:
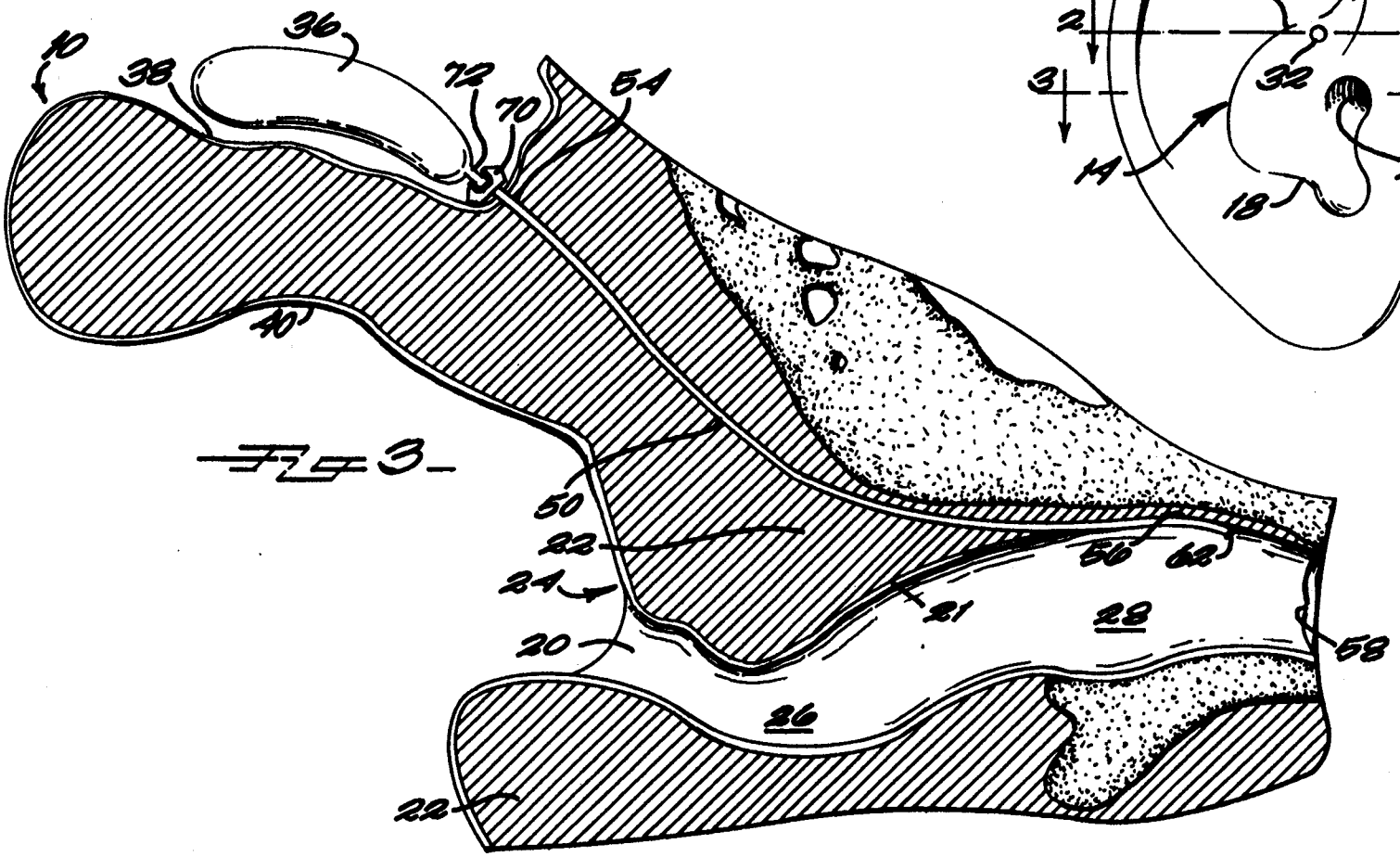
FIG. 3 is a horizontal cross-sectional view along line 3—3 of FIG. 1, showing the placement of the sound conductor.

A sound conductor 50 extends from package 36 through tissues 22 of external auditory canal region 24, generally as shown in FIG. 3. Sound conductor 50 has an outer, input end 54 connected to an output of package 36, and an inner, output end 56 that presents amplified sound close to the outer surface 58 of the user's ear drum.

Auditory canal 20 has a lateral, cerumen-producing region 26, and a medial, non-cerumen-producing region 28. Sound conductor 50 extends past region 26, bypassing region 26, and directs amplified sound medially towards the eardrum. Output end 56 extends through the skin layer 21 of canal 20, communicating with canal 20 in medial region 28. End 56 is positioned so as not to occlude canal 20 and to direct the amplified sound at ear drum 58, preferably within approximately 3–9 mm of ear drum 58 and more preferably within approximately 5–7 mm of ear drum 58. End 56 may have a rolled edge 62 as shown in FIG. 3, or, alteratively, a flat edge.

A female-type connector 70 is attached to outer end 54 of sound conductor 50, and a male-type connector 72 is attached to package 36. Connectors 70, 72 are dimensioned so as to detachably connect package 36 to sound conductor 50. Alternatively, connector 70 may be a male-type connector, and connector 72 a female-type connector.

Figure 4:
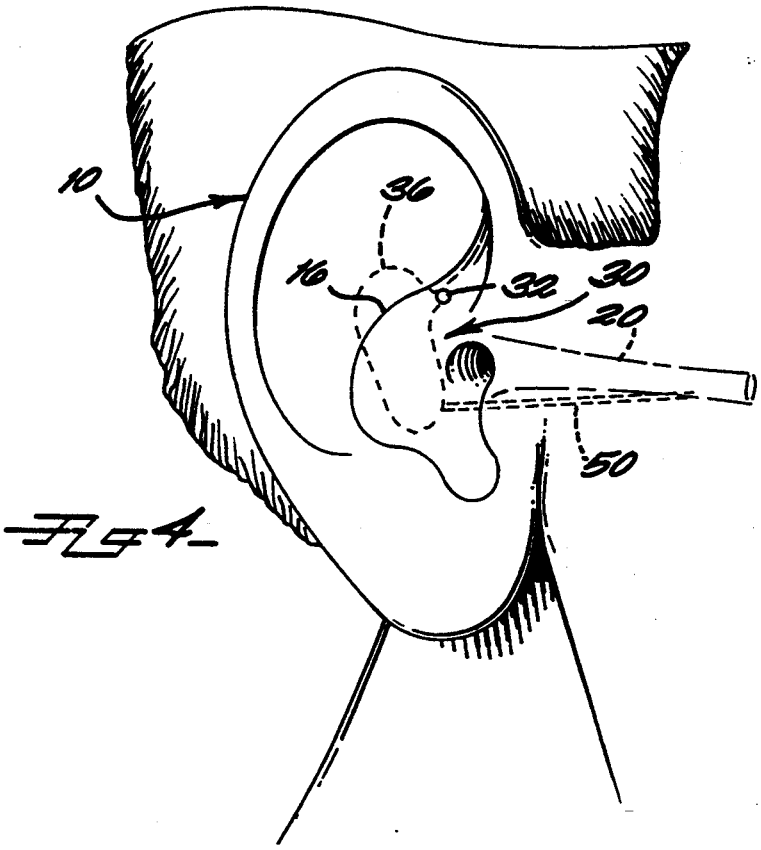
FIG. 4 is a perspective view showing the arrangement of the microphone, electronics package and sound conductor.

A view of hearing aid 30 installed for use is shown in FIG. 4. Electronics package 36 is positioned behind ear 10, connected to microphone 32 and sound conductor 50 generally as indicated. Microphone 32 collects sound waves that impinge on conchal bowl 14 and transmits an output signal to package 36, where the signal is amplified, modified, and directed to ear drum 58 by sound conductor 50. Microphone 32 is positioned in superior portion 16 of conchal bowl 14, and inner end 56 of sound conductor 50 extends only a small distance into auditory canal 20 (preferably no more than approximately 1–2 mm). Thus, canal 20 is not occluded by either microphone 32 or sound conductor 50. Rather than diminishing the user's remaining natural hearing as occurs with devices that occlude the auditory canal, hearing aid 30 enhances hearing by adding amplified sound to the user's natural hearing.

Hearing aid 30 is installed generally as follows:

1. The region posterior to auditory canal 20 and superior portion 16 of conchal bowl 14 is anesthetized, preferably by a local anesthetic. This region is readily anesthetized by many types of local anesthetics, however, other types of anesthesia or analgesia may be useful for some users.

2. A first incision is made through the skin of posterior surface 38 of pinna 12, at the location where it is desired to install microphone 32 and electronics package 36 (see FIGS. 2, 4). A small hole (hole 34) is formed through the cartilage of superior portion 16 and the skin of anterior surface 40, preferably by punching through the conchal cartilage with a suitable punching tool and incising the anterior skin with a scalpel. Hole 34 is preferably between approximately 1–3 mm in diameter, although sizes outside this range may also be useful. Most preferably, hole 34 is approximately 2 mm in diameter.

3. A stent or some other suitable type of retainer is placed in the hole to prevent closure during the healing process. The stent is rotated by the user at intervals, preferably several times daily, to prevent adhesion to the skin and cartilage and facilitate formation of a permanent, skin-lined hole 34. During healing, the area is cleaned regularly with water, alcohol, hydrogen peroxide solution or the like.

4. A second incision is made through the skin of posterior surface 38, at the desired location of outer end 54 of sound conductor 50 (FIGS. 3, 4). A trochar or other suitable device is advanced through the skin and soft tissues 22 behind auditory canal 20, and guided through the tissues until it penetrates canal 20 at the desired position of inner end 56 of conductor 50. One end of a length of flexible tubing is attached to the trochar. The trochar is then drawn back from canal 20 until the tubing extends through tissues 22, with inner end 56 in approximately the position shown in FIG. 3 and an opposing end extending outwards from posterior surface 38. Conductor 50 is cut to length, and connector 70 is attached to outer end 54.

Inner end 56 of sound conductor 50 is positioned in non-cerumen-producing region 28, medial to cerumen-producing region 26. Region 28 is normally sterile, thus, end 56 requires no special care after installation. Outer end 54 is rinsed at intervals with water, alcohol, hydrogen peroxide solution or the like, preferably at least once per day, while healing.

5. The electronics needed for operation of hearing aid 30, including an amplifier, receiver, power source, controls, and the like, are encased in a custom mold (electronics package 36) to fit snugly against posterior surface 38 of the user's ear, and permanently attached to microphone 32 via stem 42.

6. After hole 34 heals, sound conductor 50 is connected to electronics package 36 and microphone 32 is inserted into hole 34. The controls of hearing aid 30 are preferably located on the surface of package 36 so as to be readily accessible by the user.

When aid 30 is installed for use and energized, amplified sound is presented close to ear drum 58, preferably within approximately 3–9 mm of the ear drum. Due to the placement of microphone 32 in conehal bowl 14, the inherent sound collecting and amplifying properties of external ear 10 are substantially unaltered by the presence of the microphone. Neither microphone 32 nor sound conductor 50 occludes auditory canal 20, thus, the normal conduction of sound through canal 20 is not disturbed. As a result, hearing aid 30 is both "acoustically transparent" and "subjectively transparent," that is, it augments the user's remaining natural hearing rather than replacing all or part of that hearing by amplified sound. To the extent of his or her remaining natural hearing, the user receives the full harmonic range of natural sound as well as amplified sound from aid 30, and is therefore less likely to perceive the amplified sound as being abnormal or unpleasant.

Microphone 32 and electronics package 36 may be removed from the user's ear when not in use, such as while sleeping, showering, swimming, and so forth. Those components of aid 30 which contact the skin or soft tissues of the user are preferably made of biocompatible materials, as will be explained below. However, any tissue reaction in the vicinity of hole 34 may be controlled by temporarily removing microphone 32 and package 36 whenever that area is irritated or infected. The occurrence of such reactions is minimized by rinsing hole 34 at regular intervals, preferably approximately once per day, with water, alcohol, hydrogen peroxide solution, or some other mild disinfectant.

Implantable sound conductor 50 takes the form of a length of flexible tubing having an outer diameter between approximately 1–3 mm, preferably a diameter of approximately 2 min. Conductor 50 is sufficiently flexible for installation in tissues 22 of external auditory canal region 24, and is substantially imperceptible to the user after installation. Conductor 50 may be installed as shown in FIG. 3, or, alternatively, installed in some other suitable position in region 24.

Figure 5:
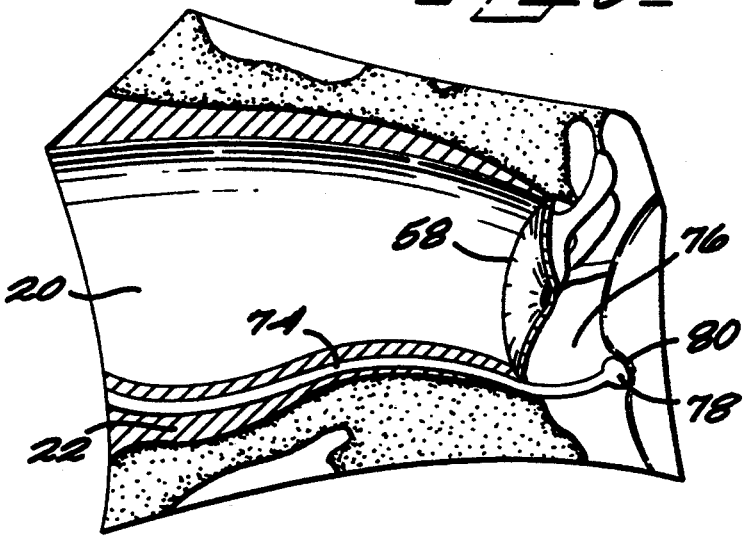
FIG. 5 shows a sound conductor according to another preferred embodiment of the present invention.

Sound conductor 50 may assume other forms without departing from the spirit of the present invention. If desired, conductor 50 may be a closed tube 74 that extends from electronics package 36 (FIG. 2) to a middle ear 76, medial to ear drum 58 (FIG. 5). Tube 74 has an inner end 78 that abuts the round window 80 of middle ear 76, thus, end 78 is preferably rounded and sufficiently flexible to conform to the shape of window 80. Tube 74 transmits sound from electronics package 36 directly to window 80. For efficient sound transmission, tube 74 is preferably filled with a biocompatible fluid such as physiological saline solution.

Figure 6A:
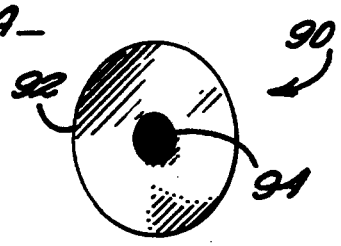
FIGS. 6A and 6B shows a sound conductor according to still another preferred embodiment of the present invention.
Figure 6B:
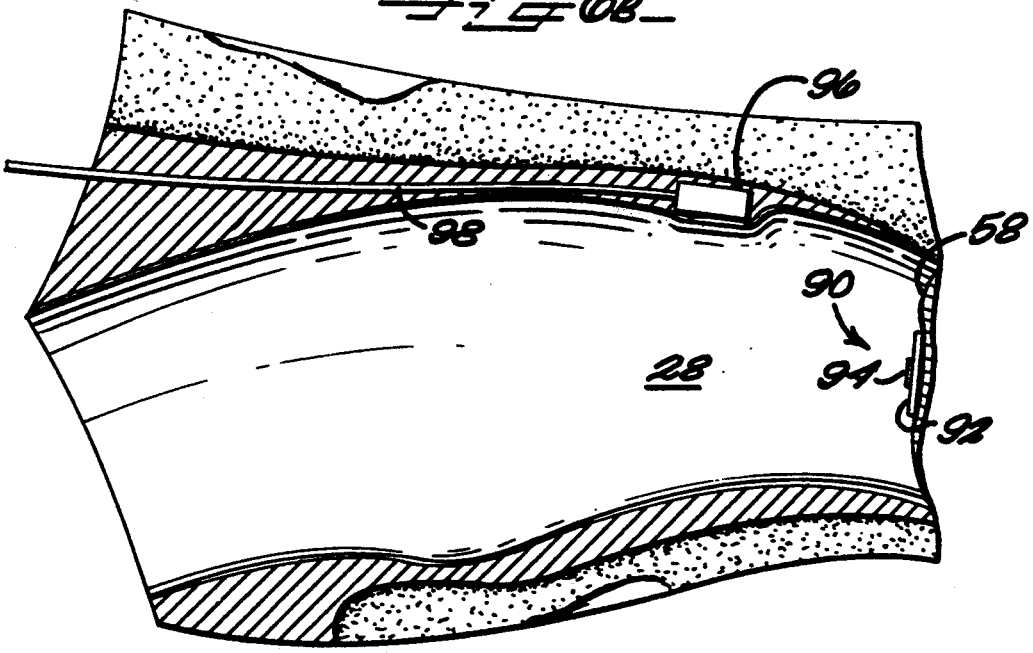

Alteratively, a lens 90, including a membrane 92 and a magnet 94, may be carded by ear drum 58 (FIGS. 6A and 6B). An electromagnetic driver 96 is installed in tissues 22 of external auditory canal region 24, preferably medial to cerumen-producing region 26 and positioned within approximately 2–10 mm of ear drum 58. Electromagnetic driver 96 is connected to electronics package 36 by an insulated wire 98. Electromagnetic driver 96 transmits an electromagnetic signal to lens 90. Magnet 94 is any suitable type of permanent magnet, such as a samarium cobalt magnet encased in silastic or similar biocompatible material.

As shown in FIGS. 3 and 4, conductor 50 has an approximately constant diameter throughout its length, however, a variable-diameter sound conductor may be used. A variable-diameter sound conductor for use with the invention might be, for example, a "Libby tube" having a diameter that increases gradually from outer end 54 to inner end 56. Use of a Libby tube for conductor 50 increases the high-frequency output of the conductor due to enhanced conduction of high frequencies by such tubing, thereby increasing the perceived "natural" quality of the amplified sound. However, any loss of natural high frequency harmonics due to use of a constant-diameter sound conductor can readily be compensated for by suitably-programmed electronics in package 36.

Conductors 50 and 74 are made of a biocompatible material that is well tolerated by body tissues. Suitable materials include GORE-TEX TM, silicon rubber compositions such as SILASTIC TM, and GORE-TEX TM — coated SILASTIC TM. Polytetrafluoroethylene tubing (PTFE, TEFLON TM) and PARYLENE TM tubing may also be used. These materials are well tolerated by most users, with almost no foreign body reactions. However, flexible tubing made of other biocompatible materials may also be useful. Wire 98 and amplifier 96, if present, are covered by biocompatible materials such as those listed above.

The material of conductors 50 and 74 may be impregnated with silver to help reduce the incidence of infections. Similarly, wire 98 and amplifier 96 may be covered by a silver-impregnated material. Alteratively, conductors 50 and 74 may be provided with silver-impregnated outer coatings or cuffs at the junctions of ends 54 and 56 with the skin. Inner end 56 of conductor 50 is positioned in a normally-sterile portion of auditory canal 20, away from the active glandular (i.e., cerumen-producing) portion of the external auditory canal, so the possibility of infection is minimized. Any infections that occur may be treated with local care (irrigation with mild disinfectants such as alcohol and hydrogen peroxide; application of topical antibiotics). If desired, disinfectants and topical antibiotics may be injected into conductor 50 for delivery to region 28 of auditory canal 20. Conductor 50 may be removed if necessary, and replaced after the infection clears.

Microphone 32 is preferably an omnidirectional microphone, oriented facing approximately forwards to take advantage of the natural sound-collecting properties of ear 10. While an omnidirectional microphone is preferred, other types of microphones including directional microphones may also be useful. The optimum type of microphone for hearing aid 30 depends on such factors as the size of the microphone, its precise position in the user's concha, and the components of electronics package 36. The external ear is a natural parabolic sound collector from the front; and superior portion 16 of conchal bowl 14 is well shadowed and protected from wind and wind noise. The signal-to-noise ratio of hearing aid 30 is increased by placing microphone 32 in the natural sound collector of the concha and by avoiding occlusion of external auditory canal 20. As noted above, increased signal-to-noise ratios are crucial to understanding speech in a noisy environment. The signal-to-noise ratio of aid 30 may be as much as 15 dB higher than that of canal-occluding aids. For those users who need binaural amplification, use of an aid 30 in each ear results in further improvements in the signal-to-noise ratio.

Microphone 32 may extend above anterior surface 40, preferably by no more than 1–3 mm. Alternatively, microphone 32 may be approximately flush with surface 40. Microphone 32 may be flesh-colored to enhance its inconspicuousness. However, some users may prefer a microphone 32 having a decorative appearance similar to a small earring.

Microphone 32 and electronics package 36 are removably attached to the user's ear. Microphone 32 may be permanently attached to stem 42, or may be detachable from stem 42 and package 36. By way of example, stem 42 may have a diameter approximately equal to the diameter of hole 34, but preferably slightly larger than the diameter of the hole. Stem 42 may also carry a collar 64 (FIG. 2). The user installs microphone 32 in conchal bowl 14 by gently pushing the microphone into hole 34 from the rear. Stem 42 is held in place by collar 64 and by friction between the stem and the skin lining hole 34. In addition, the underlying cartilage has some tensile strength and can "grip" stem 42. Microphone 32 is removed by grasping package 36 and gently pulling backwards.

Microphone 32 and package 36 are configured as a "reverse earring," with microphone 32 pushed onto stem 42 after the stem is installed in hole 34. Alternatively, microphone 32 may be attached to stem 42, so that stem 42 is inserted into hole 34 from the front for connection to a suitable input connector (not shown) on package 36. Since stem 42 is dimensioned to fit in hole 34, the length of stem 42 is approximately equal to the thickness of the cartilage at the location of hole 34. If desired, the outer surface of microphone 32 may be approximately flush with anterior surface 40 except for a flange to help retain the microphone in position. As will be evident, other methods for installing microphone 32 and package 36 may be used without departing from the spirit of the present invention. By way of example, the anterior skin over hole 34 may be left intact when the hole is formed. Then, stem 42 and microphone 32 are simply pushed into hole 34 from the rear, held in place by the natural tensile strength of the conchal cartilage. A tube or stent may be permanently implanted in hole 34 to serve as a guide and retainer for stem 42.

Stem 42 is preferably substantially rigid in order to facilitate insertion into hole 34 (and removal from hole 34), and hollow to accommodate electrical connections between microphone 32 and electronics 36. Stem 42 is made of a biocompatible material, including but not limited to stainless steel, gold, gold-plated metal, and ceramic. Stem 42 may coated with a material such as silicone rubber or polytetrafluoroethylene.

Electronics package 36 may contain an amplifier that is responsive to the output signal of microphone 32, a battery, user-operable controls, frequency-compensation circuitry, a receiver, and such other electronics as are needed for operation of hearing aid 30. These parts may be selected from any readily-available, conventional components that are suitable for use with microphone 32 and sound conductor 50. Electromagnetic driver 96, if present, is any suitable type of electromagnetic driver that can be implanted in tissues 22. The components of hearing aid 30 may be selected for each particular user's individual needs. Thus, users with severe hearing loss may benefit from a more powerful amplifier than those with relatively mild hearing loss, and music lovers may benefit from an amplifier with adjustable frequency ranges.

Package 36 is encased in a substantially water-impervious outer housing, preferably individually molded to fit behind the user's ear and conform to the shape of the ear and the head. Stem 42 is positioned so that, when package 36 is installed for use, the stem is directly insertable into hole 34 with attached microphone 32. Package 36 is dimensioned to fit comfortably behind the ear, no greater than approximately 2 cm long×1 cm in diameter. It will be evident that the size and weight of package 36 depends on the choice of amplifier, power supply, and so forth that are selected for aid 30. Preferably, package 36 weighs less than approximately 28 g (about 1 ounce), and more preferably less than approximately 14 g (about ½ ounce).

When installed for use, package 36 is attached to the user's ear at two points: by stem 42 and microphone 32 at hole 34, and by connectors 70, 72 at outer end 54 of sound conductor 50. Package 36 is supported by microphone 32, in a manner similar to a pierced earring held by an earring stud. Connection to end 54 stabilizes package 36, adding to the user's comfort and providing additional support. Therefore, to minimize strain on implanted conductor 50, stem 42 and connector 72 are preferably approximately the same distance apart as hole 34 and outer end 54. Because conductor 50 delivers sound to the region of ear drum 58, and microphone 32 is placed in the relatively distant location of conchal bowl 14, the problem of feedback is greatly reduced. Feedback is also reduced when a sound conductor such as conductor 74 is used, since amplified sound is delivered in a relatively distant location from microphone 32.

Since only the sound conductor of hearing aid 30 is permanently implanted, the need to remove a failed portion of the device is minimized. Those portions of hearing aid 30 that are most likely to need replacement or maintenance—microphone 32 and electronics package 36—are not implanted and therefore are readily available for maintenance as needed.

By providing a sound conductor that bypasses cerumen-producing region 26 of the external auditory canal, a hearing aid 30 according to the present invention avoids the predisposition to external otitis caused by in-the-ear hearing aids. In addition, the cosmetic appearance of aid 30 is improved over that of many currently-available hearing aids. Electronics package 36, containing a battery, amplifier, and so forth, is placed behind the ear, where it is concealed by the ear and the user's hair. Only microphone 32 shows in superior portion 16 of conchal bowl 14. User-operable controls on package 36 may be made simply to minimize difficulty in manipulating the controls.

Other problems experienced by users of presently-available devices are avoided, including ear canal occlusion, secondary abnormal sensation and the abnormal quality of amplified sound. Discomfort is avoided because the external ear is a relatively soft and compliant site for the placement of a hearing device. Once installed, hearing aid 30 is no more perceptible by the user than is an earring. The power needs of aid 30 are reduced since the amplified sound is presented close to the user's ear drum. Reduced feedback achieved by the separation of sound conductor 50 and microphone 32 enables greater amplification without the limitation of feedback. Finally, the sound comes from the portion of the ear that is used for collecting sound but without the usual ear canal blockage, so the quality of sound that is received by the wearer, from the present invention and directly from the ear canal, is more like that the wearer enjoyed before his or her hearing became impaired.

It will be apparent to those skilled in the art that many changes and substitutions can be made to the preferred embodiment herein described without departing from the spirit and scope of the present invention as defined by the appended claims.

What is claimed is:

1. A hearing aid for use with an ear having a pinna with an anterior side and a posterior side, and an auditory canal with a skin layer and an ear drum, comprising:

a microphone that produces an output signal;

means for amplifying said output signal to produce an amplified output signal, said amplifying means responsive to said output signal from said microphone;

a stem having a first end carrying said microphone and a second, opposing end attached to said amplifying means, said stem dimensioned to extend through a hole in said pinna so that said microphone is held on said anterior side for receiving sounds impinging on said anterior side and said amplifying means is held on said posterior side;

means connected to said amplifying means for conducting said amplified output signal into said ear.

2. The hearing aid as recited in claim 1, wherein said conducting means is dimensioned to conduct said amplified signal from said amplifying means, when said amplifying means is on said posterior side of said pinna, through said skin layer of said auditory canal.

3. The hearing aid as recited in claim 1, wherein said auditory canal has a cerumen-producing region and a non-cerumen-producing region medial to said cerumen-producing region, and wherein said conducting means is dimensioned to pass into said non-cerumen-producing region, but not through said cerumen-producing region, of said auditory canal from said amplifying means when said amplifying means is on said posterior side of said pinna.

4. The hearing aid as recited in claim 1, wherein said amplifying means further comprises a housing conformed to said posterior side of said pinna.

5. The hearing aid as recited in claim 1, wherein said pinna has a conchal bowl, and wherein said amplifying means further comprises a housing conformed to said posterior side of said pinna, and said stem is connected to said housing so that, when said housing is placed against said posterior side of said pinna, said stem passes into said conchal bowl of said pinna.

6. The hearing aid as recited in claim 1, and wherein said amplifying means further comprises a housing to which said conducting means and said stem are attached in such a way that, when said stem is positioned by said body to pass through said pinna from said posterior side to said anterior side, said conducting means is oriented by said amplifying means to pass through said external auditory canal and through said skin layer of said auditory canal.

7. The hearing aid as recited in claim 1, wherein said stem has a flange on said first end to hold said microphone on said anterior side of said pinna.

8. The hearing aid as recited in claim 1, wherein said ear has a round window, and wherein in said conducting means is a hollow tube filled with a fluid, said tube dimensioned to extend from said amplifying means to said round window.

9. A hearing aid for use with an ear having a pinna with an anterior side and a posterior side, and an auditory canal with a skin layer and an ear drum, said heating aid comprising:

a housing;

a microphone that produces an output signal;

means within said housing for amplifying said output signal to produce an amplified output signal, said amplifying means in electrical connection with said microphone and responsive to said output signal;

a stem having a first end carrying said microphone and a second, opposing end attached to said housing, said stem dimensioned to extend through a hole in said pinna so that said microphone is held on said anterior side when said housing is held on said posterior side;

means connected to said amplifying means for conducting said amplified output signal to said ear drum through said skin layer of said auditory canal.

10. The hearing aid as recited in claim 9, wherein said auditory canal has a cerumen-producing region and a non-cerumen-producing region medial to said cerumen-producing region, and wherein said conducting means is dimensioned to pass into said non-cerumen-producing region of said auditory canal, but not through said cerumen-producing region, from said amplifying means when said amplifying means is positioned on said posterior side of said pinna.

11. The hearing aid as recited in claim 9, wherein said conducting means conducts said amplified output signal to within approximately 3 to approximately 9 mm of said ear drum.

12. The hearing aid as recited in claim 9, wherein said conducting means conducts said amplified output signal to within approximately 5 to approximately 7 mm of said ear drum.

13. The hearing aid as recited in claim 9, wherein said pinna has a conchal bowl, and wherein said housing is conformed to said posterior side of said pinna, and said stem is connected to said housing so that, when said housing is put into position with respect to said posterior side of said pinna, said stem will extend through a hole formed in said conchal bowl of said pinna.

14. The hearing aid as recited in claim 9, wherein said housing further comprises means for detachably connecting said conducting means to said housing.

15. The hearing aid as recited in claim 9, wherein said stem has a flange on said first end to hold said microphone on said anterior side of said pinna.

16. The hearing aid as recited in claim 9, wherein said ear has a round window, and wherein in said conducting means is a hollow tube filled with a fluid, said tube dimensioned to extend from said amplifying means to said round window.

17. A method for installing a hearing aid, said hearing aid including a microphone, means for amplifying sound received from said microphone, and means for conducting amplified sound, said method comprising the steps of:

forming a hole in the conchal bowl of an ear;

forming a passage through said external auditory canal to a position in said auditory canal medial to the cerumen-producing portion of said auditory canal, but not through said cerumen-producing portion;

installing said conducting means in said passage so that said conducting means runs from outside said ear to said position medial to the cerumen-producing portion of the auditory canal of said ear;

placing said amplifying means against the posterior side of said ear with said microphone in said hole through said conchal bowl so that said microphone can receive sounds impinging on the anterior side of said ear; and connecting said conducting means to said amplifying means.

18. The method as recited in claim 17, wherein said hole-forming step further comprises the steps of:

making a skin incision in the posterior skin of the concha; and through said incision, forming a hole through the cartilage and the anterior skin of the concha.

19. The method as recited in claim 17, wherein said hole-forming step further comprises forming said hole in the superior portion of the conchal bowl.

20. The method as recited in claim 17, wherein said passage-forming step further comprises-the steps of:

making a skin incision in the posterior skin of the concha, said incision positioned behind the auditory canal;

passing a trochar through said incision into soft tissues of the external auditory canal region; and guiding said trochar through said soft tissues into the non-cerumen-producing portion of the auditory canal.

* * * * *